US009867446B2

(12) United States Patent
Lee

(10) Patent No.: US 9,867,446 B2
(45) Date of Patent: Jan. 16, 2018

(54) COSMETIC CONTAINER HAVING INNER CONTAINER AND SEALING STRUCTURE FOR INNER CONTAINER CAP

(71) Applicant: PUM-TECH KOREA CO., LTD., Incheon (KR)

(72) Inventor: Do Hoon Lee, Incheon (KR)

(73) Assignee: PUM-TECH KOREA CO., LTD., Bupyeong-Gu, Incheon (KR)

( * ) Notice: Subject to any disclaimer, the term of this patent is extended or adjusted under 35 U.S.C. 154(b) by 0 days.

(21) Appl. No.: 15/120,445

(22) PCT Filed: Mar. 5, 2015

(86) PCT No.: PCT/KR2015/002116
§ 371 (c)(1),
(2) Date: Aug. 19, 2016

(87) PCT Pub. No.: WO2015/133832
PCT Pub. Date: Sep. 11, 2015

(65) Prior Publication Data

US 2017/0065057 A1 Mar. 9, 2017

(30) Foreign Application Priority Data

Mar. 7, 2014 (KR) ..... 20-2014-0001851 U

(51) Int. Cl.
*B65D 43/18* (2006.01)
*A45D 40/22* (2006.01)
(Continued)

(52) U.S. Cl.
CPC ..... *A45D 40/22* (2013.01); *A45D 33/008* (2013.01); *A45D 33/24* (2013.01); *B65D 43/165* (2013.01);
(Continued)

(58) Field of Classification Search
CPC ..... A45D 40/22–40/222; A45D 2040/223–2040/228;
(Continued)

(56) References Cited

U.S. PATENT DOCUMENTS 1,930,532 A * 10/1933 Mitchell ..... A45D 33/006 132/300
2,509,355 A * 5/1950 Kampa ..... A45C 13/005 220/845
(Continued)

FOREIGN PATENT DOCUMENTS

KR WO20111-115346 A1 9/2011
KR 10-2013-0048518 A 10/2013
(Continued)

*Primary Examiner* — Kareen Thomas
(74) *Attorney, Agent, or Firm* — Lucern, PC; Heedong Chae

(57) ABSTRACT

The present invention relates to a cosmetic container having an inner container and a sealing structure for an inner container cap and, more specifically, to a cosmetic container having an inner container and a sealing structure for an inner container cap in which an outer wall of the inner container is formed to have a larger diameter than a sealing projecting ring formed on the lower portion of the inner container cap such that the sealing projecting ring is forcibly inserted into the outer wall of the inner container, and a first hinge block having an oval hinge hole formed therein is formed on a side of the inner container such that a hinge pin is able to move up and down in the hinge hole, thereby enhancing a force for sealing the interior of the inner container when the inner container is closed.

14 Claims, 9 Drawing Sheets

(51) Int. Cl.

| | |
|---|---|
| ***A45D 33/24*** | (2006.01) |
| ***A45D 33/00*** | (2006.01) |
| ***B65D 43/16*** | (2006.01) |
| ***B65D 53/02*** | (2006.01) |
| *A45D 40/00* | (2006.01) |

(52) U.S. Cl.
CPC ..... *B65D 53/02* (2013.01); *A45D 2040/0018* (2013.01); *A45D 2200/051* (2013.01)

(58) Field of Classification Search
CPC .... A45D 33/003–33/008; A45D 33/24; A45D 2040/0018; A45D 2200/051; B65D 53/02; B65D 43/165
USPC ..... 220/259.2, 256.1, 259.1, 810, 826, 244, 220/845, 847, 848, 843, 23.86, 23.87
See application file for complete search history.

(56) References Cited

U.S. PATENT DOCUMENTS

| | | | | |
|---|---|---|---|---|
| 4,345,607 | A * | 8/1982 | Contreras ..... | A45C 11/24 16/227 |
| 4,693,392 | A * | 9/1987 | Contreras, Sr. ..... | A45D 40/22 220/827 |
| 4,863,034 | A * | 9/1989 | Contreras, Sr. ..... | A45D 40/22 132/294 |
| 4,917,131 | A * | 4/1990 | Contreras, Sr. ..... | A45D 40/22 132/286 |
| 6,199,559 | B1 | 3/2001 | Nikolaus et al. | |
| 2004/0221866 | A1 * | 11/2004 | Greenfield ..... | A45D 33/20 132/287 |
| 2008/0173324 | A1 * | 7/2008 | Washington ..... | A45D 33/008 132/295 |
| 2008/0190444 | A1 * | 8/2008 | Bennett ..... | A45D 33/006 132/306 |
| 2012/0305606 | A1 * | 12/2012 | Lee ..... | A45D 33/02 222/256 |
| 2015/0027487 | A1 * | 1/2015 | Apodaca ..... | A45D 33/006 132/307 |

FOREIGN PATENT DOCUMENTS

| | | | |
|---|---|---|---|
| KR | 10-1318467 | B1 | 10/2013 |
| KR | WO2014-017800 | A1 | 1/2014 |

* cited by examiner

COSMETIC CONTAINER HAVING INNER CONTAINER AND SEALING STRUCTURE FOR INNER CONTAINER CAP

CROSS-REFERENCE TO RELATED APPLICATION

This application claims the benefit of Korean Application No. 20-2014-0001851, filed on Mar. 7, 2014 with the Korean Intellectual Property Office, the disclosure of which is incorporated herein by reference.

TECHNICAL FIELD

The present invention relates to a cosmetic container having a sealing structure between an inner container and an inner container cap, and more particularly to a cosmetic container having a sealing structure between an inner container and an inner container cap, capable of improving internal sealing force of the inner container when the inner container is closed by forming a diameter of a sealing projecting ring formed at a lower portion of the inner container cap, which is larger than that of an outer wall of the inner container, to forcibly fit the sealing projecting ring into the outer wall, and by forming a first hinge block having an oval-shaped, hinge hole at one side of the inner container so that a hinge pin can be moved up and down in the hinge hole.

In addition, the present invention relates to a cosmetic container having a sealing structure between an inner container and an inner container cap, in which an extension projecting ring is formed on an upper portion of an inner container cap, the extension projecting ring includes three protruding parts and three recess parts formed in a wave shape and at equal angles, and a press projecting ring is formed at an inside of a lower portion of an outer container cap corresponding to the protruding parts of the extension projecting ring, so that the pressing projecting ring presses the three protruding parts of the extension projecting ring when the outer container cap is closed, thereby generating internal pressure of the inner container. In this case, as the outer container cap is coupled to the outer container, the inner container cap is prevented from being lifted up.

BACKGROUND ART

Cosmetics refer to compositions which are used for a human body in order to add charming of the human body, to change the appearance of the human body into being brighter, to maintain skin or hair in a healthy state, or and to enhance the skin or the hair by making the human body clean and beautiful. The cosmetics may be mainly classified into basic, color, and functional cosmetics. The color cosmetics may representatively include powder and foundation.

The foundation is significantly useful to express skin color representing a desired ambience by uniformly adjusting the skin color. The foundation covers melasma, freckles, or blemishes, which are defects of the skin, to stand out point makeup.

In addition, since the foundation protects a skin from pollution, dust, or ultra-violet light, and corrects a facial outline to make the facial outline clear, the foundation has been extensively used.

The foundation is frequently contained in a foundation container having a structure to receive a mirror and a puff and used. The mirror received in the foundation container is generally attached to an inside of the cap of an outer container. The puff is generally placed on a cap to cover an inner container having cosmetic contents therein.

The foundation container receives and stores an immersion member or gel-phase color cosmetic contents. When the user uses the foundation container, the user may press a button provided on a front surface of a container body to open an external cap of the container body through hinge-rotation, and applies cosmetics to the face of the user using a cosmetic tool, such as a puff or a brush, received in the foundation container to make up the face of the user.

However, since the foundation contains a large amount of volatile solvent, when the sealing force of the inner container, which receives the foundation-type cosmetics, is degraded, the volatile solvent may be evaporated in the atmosphere. Accordingly, the foundation is hardened, so that the original function of the foundation may be lost. Therefore, there is required a method of preventing the volatile solvent of the foundation from being evaporated.

In order to solve the problem, as shown in FIG. 1, a cosmetic container having an airtight refill case is disclosed in Korean Patent Registration No. 10-1318467. According to the related art, the cosmetic container includes a container body 1, a container cap 2 which is open/closed through hinge-coupling with the container body 1, and a refill case 3 received in the container body 1.

The refill case 3 has a structure in which an upper cap 4 and a lower body 5 are coupled to each other by a butterfly hinge, an assembly groove part 6 formed in an upper end of an outer wall of the lower body 5 and having a ring-shaped assembly protrusion and an assembly protrusion part 7 formed on a lower portion of the upper cap 4 and having a ring-shaped assembly groove provide a double airtight coupling structure, and the lower portion of the container cap 2 presses a pressing protrusion part 8 formed in the upper cap 4 when the container cap 2 is closed, thereby ensuring more excellent airtightness of the refill case 3. Accordingly, external air can be prevented from being introduced into the refill case 3 or moisture or a volatile component can be prevented from being evaporated from being ail inner part of the refill case 3.

However, according to the related art, when the upper cap 4 is pressed and closed to seal the refill case 3, the upper cap 4 may be lifted up due to pressure remaining in the lower body 5 of the refill case 3. Accordingly, the sealing force of the refill case 3 may be degraded.

In addition, since only two pressing protrusion parts 8 are formed on the upper cap 4 of the refill case 3, when the container cap 2 presses the pressing protrusion part 8, the upper cap 4 is one-sided and pressed, so that sealing is not perfectly formed, but a volatile component of the cosmetic contents in the refill case 3 is volatilized, so that merchantability may be degraded.

DISCLOSURE

Technical Problem

The present invention is made in order to solve the problem occurring in the related art, and an object of the present invention is to provide a cosmetic container having a sealing structure between an inner container and an inner container cap, capable of improving internal sealing force of the inner container when the inner container is closed by forming a diameter of a sealing projecting ring formed at a lower portion of the inner container cap, which is larger than that of an outer wall of the inner container, to forcibly fit the sealing projecting ring into the outer wall, and by forming a first hinge block having an oval-shaped hinge hole at one side of the inner container so that a hinge pin can be moved up and down in the hinge hole.

In addition, another object of the present invention is to provide a cosmetic container having a sealing structure between an inner container and an inner container cap, in which an extension projecting ring is formed on an upper portion of an inner container cap, the extension projecting ring includes three protruding parts and three recess parts formed in a wave shape and at equal angles, and a press projecting ring is formed at an inside of a lower portion of an outer container cap corresponding to the protruding parts of the extension projecting ring, so that the pressing projecting ring presses the three protruding parts of the extension projecting ring when the outer container cap is closed, thereby generating internal pressure of the inner container. In this case, as the outer container cap is coupled to the outer container, the inner container cap is prevented from being lifted up.

Technical Solution

The present invention provides a cosmetic container having a sealing structure between an inner container and an inner container cap, which includes:

an outer container (10) formed therein with an inner container receiving groove (11);

an outer container cap (20) hinged with the outer container (10) and formed therein with a press projecting ring (22);

an inner container (30) received in the outer container (10) and having an outer wall (33) and a first hinge block (34); and an inner container cap (40) hinged with the first hinge block (34) of the inner container (30), wherein the inner container cap (40) is formed at a lower portion thereof with a sealing projecting ring (42), and an outer diameter of the sealing projecting ring (42) is larger than an inner diameter of the outer wall (33) of the inner container (30) such that the inner container cap (40) is forcibly fitted into an inside of the outer wall (33), and wherein the inner container cap (40) is formed at an upper portion thereof with an extension projecting ring (43) to be pressed by the press projecting ring (22) of the outer container cap (20).

In addition, according to the present invention, an inner wall (32) is additionally formed inside the cuter wall (33) of the inner container (30).

In addition, according to the present invention, the first hinge block (34) is formed therein with a hinge hole (341) having an oval shape.

Further, according to the present invention, the extension projecting ring (43) includes three protrusion parts (431) and three recess parts (432) which are repeatedly formed and formed at equal angles.

Further, a fixing member (50) is additionally coupled between an inner wall (32) and the outer wall (33) of the inner container (30).

Advantageous Effects

As described above, according to the cosmetic container having the sealing structure between the inner container and the inner container cap of the present invention, when the inner container is closed, internal sealing force of the inner container can be improved by forming the diameter of the sealing projecting ring formed at the lower portion of the inner container cap, which is larger than the diameter of the outer wall of the inner container, to forcibly fit the sealing projecting ring into the outer wall, and by forming the first hinge block having the oval-shaped hinge hole at one side of the inner container so that the hinge pin can be moved up and down in the hinge hole.

In addition, according to a cosmetic container having a sealing structure between an inner container and an inner container cap of the present invention, the extension projecting ring is formed on the upper portion of the inner container cap, the extension projecting ring includes three protruding parts and three recess parts formed in the wave shape and at equal angles, and a press projecting ring is formed at an inside of a lower portion of the outer container cap corresponding to the protruding parts of the extension projecting ring, so that the pressing projecting ring presses the three protruding parts of the extension projecting ring when the outer container cap is closed, thereby generating internal pressure of the inner container. In this case, as the outer container cap is coupled to the outer container, the inner container cap can be prevented from being lifted up.

BEST MODE

Mode for Invention

Hereinafter, a cosmetic container having a sealing structure between an inner container and an inner container cap will be described with reference to accompanying drawings.

Figure 1:
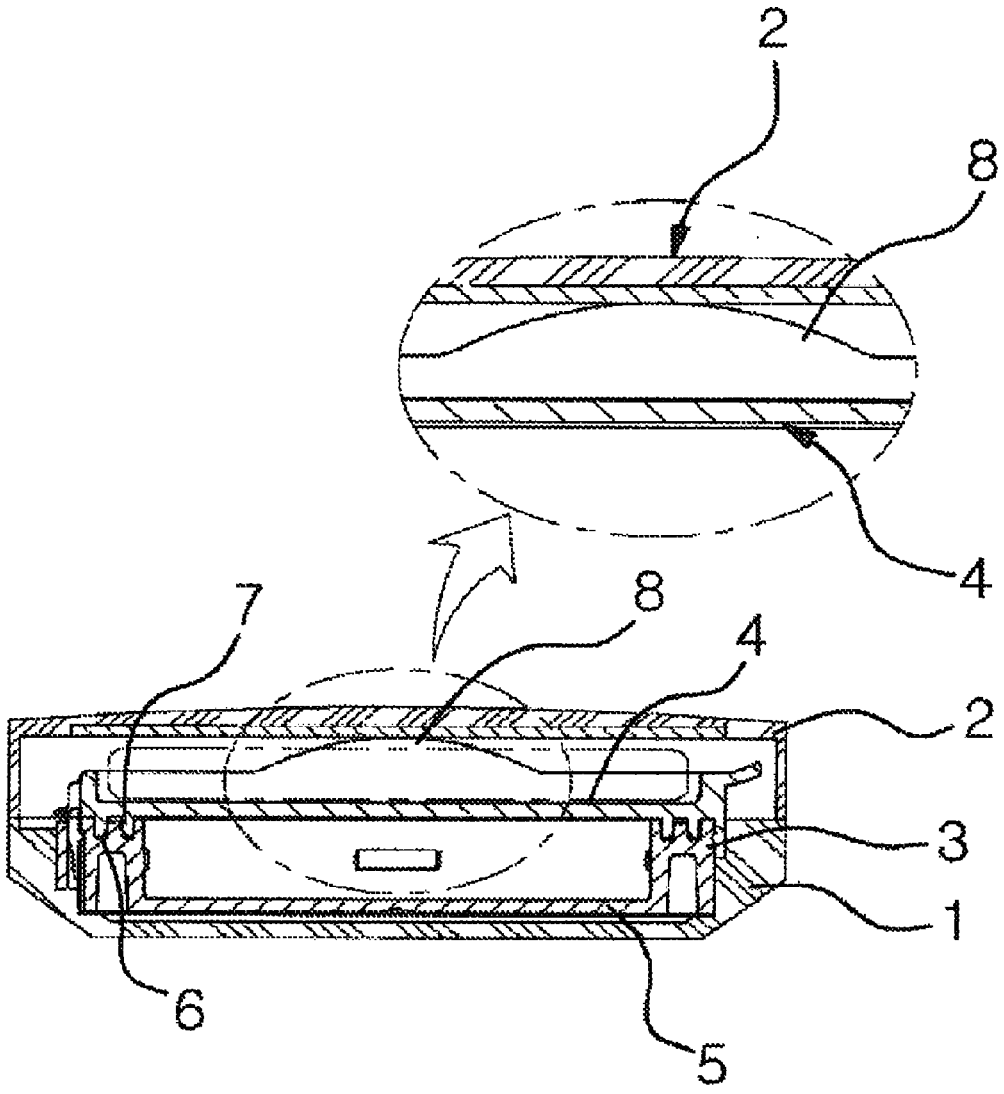
FIG. 1 is a cosmetic container having an air-tight-type refill case according to the related art.
Figure 2:
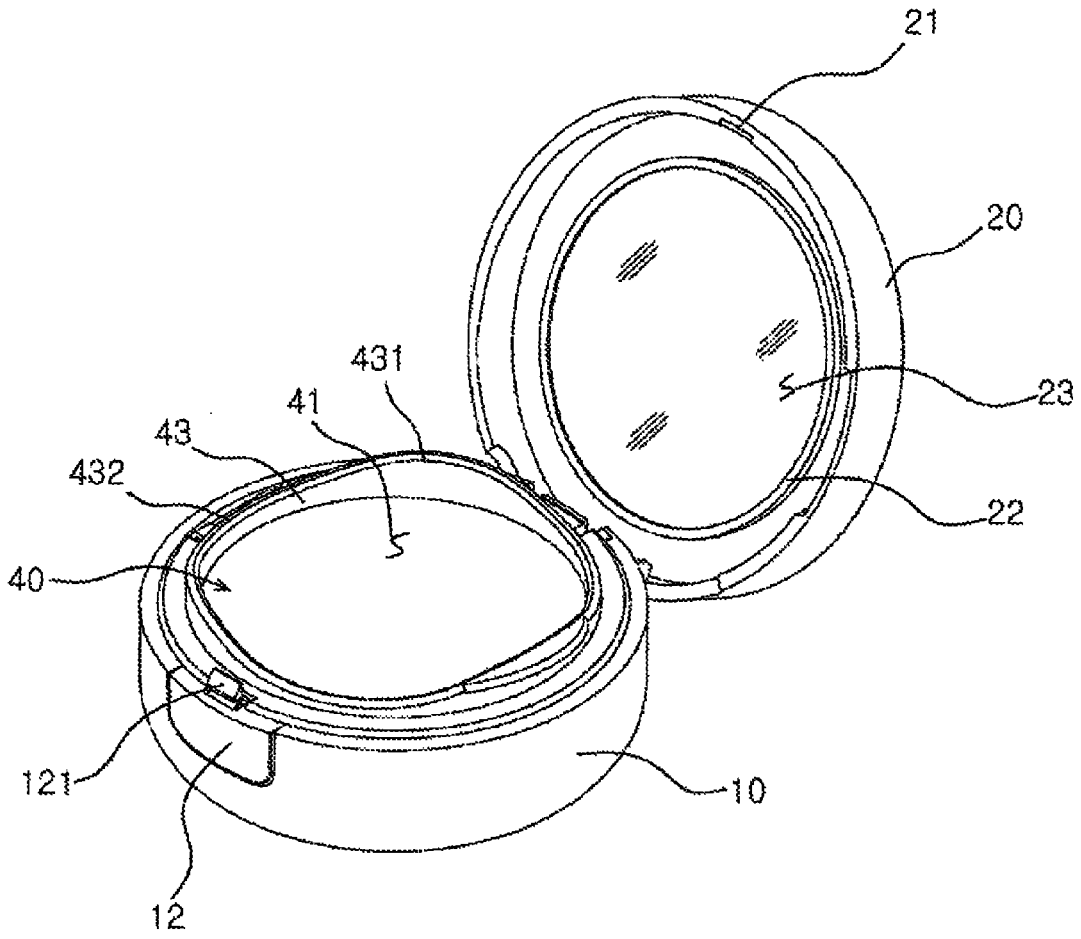
FIG. 2 is a perspective view showing an open state of an outer container in a cosmetic container having a sealing structure between an inner container and an inner container cap according to one embodiment of the present invention.
Figure 3:
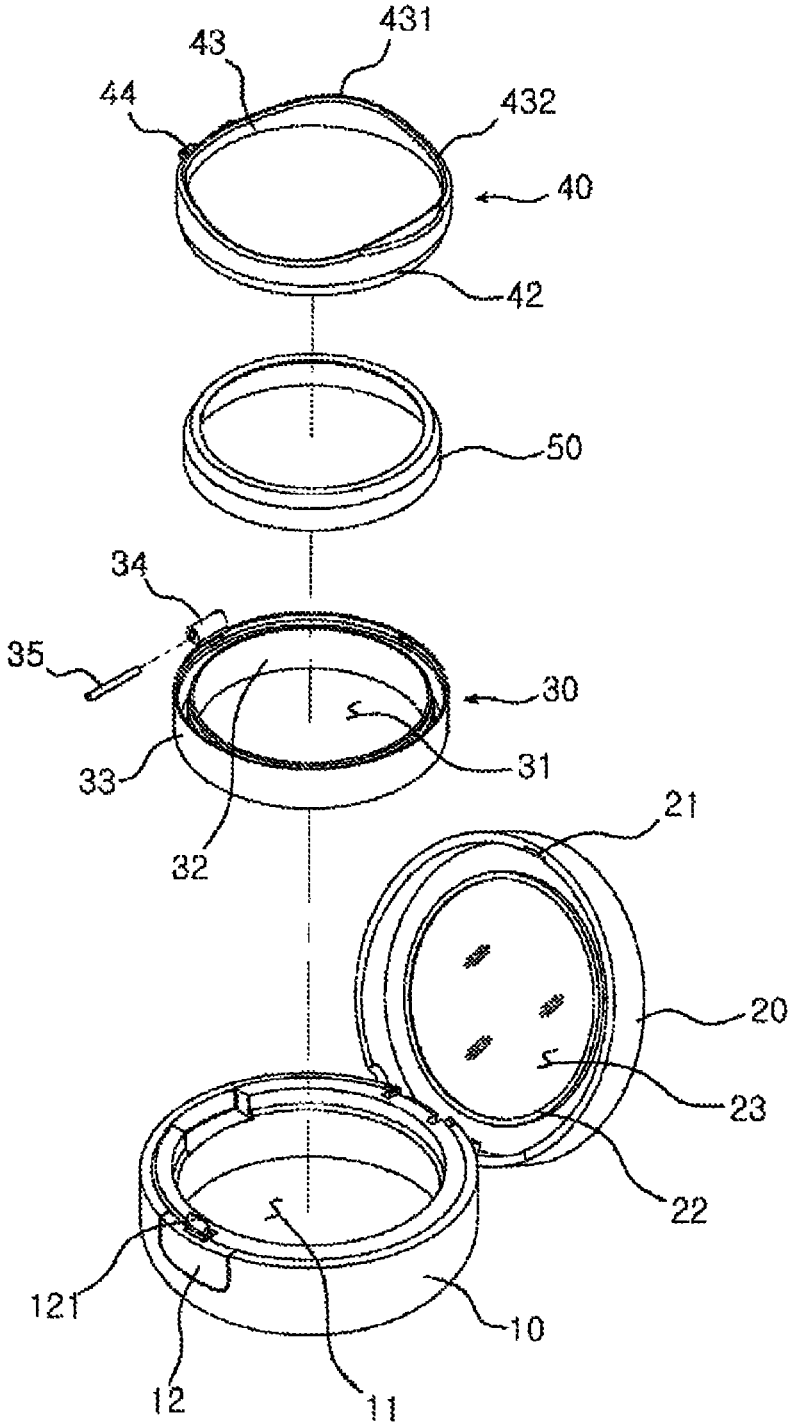
FIG. 3 is an exploded perspective view showing the cosmetic container having the sealing structure between the inner container and the inner container cap according to one embodiment of the present invention.
Figure 4:
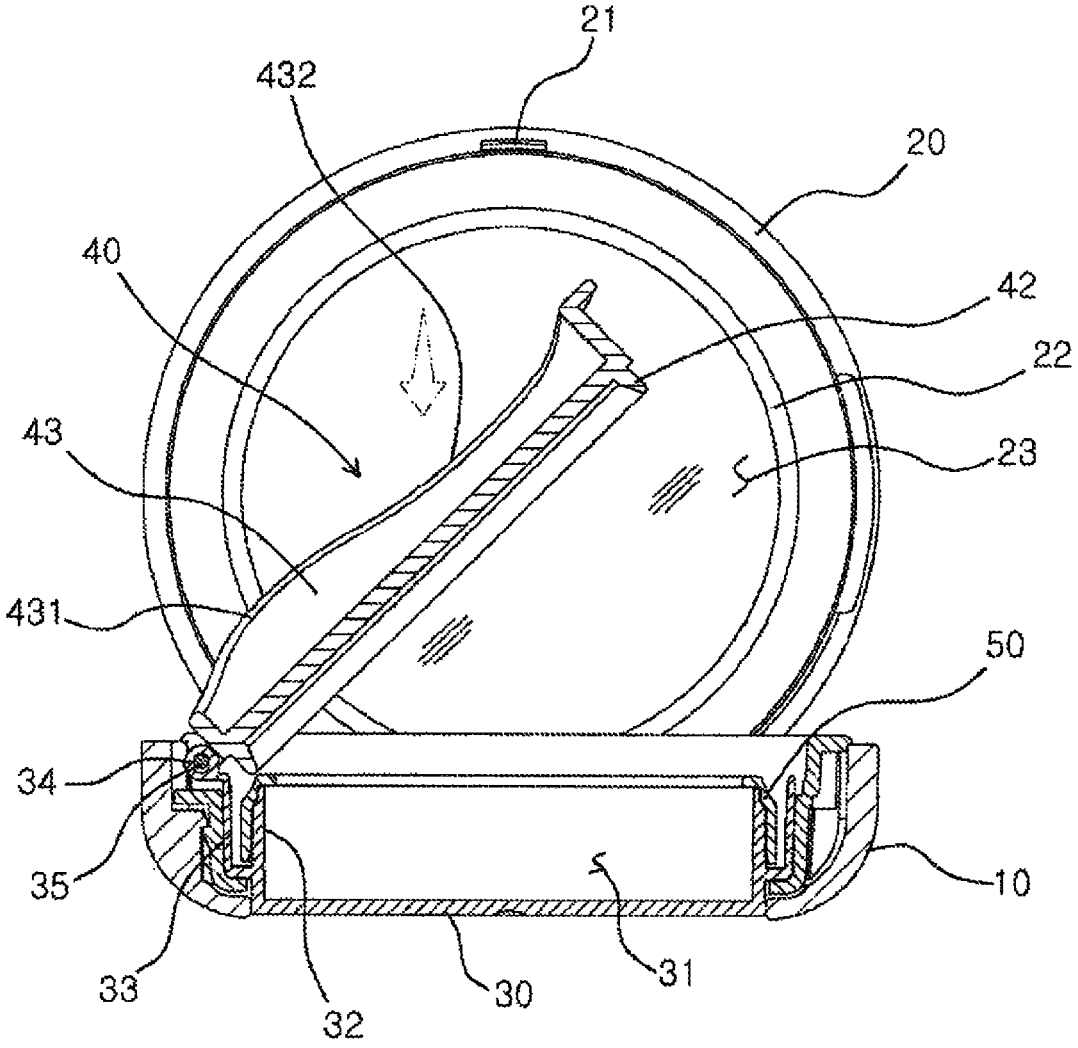
FIG. 4 is a sectional view showing the closing state of an inner container when the outer container is open in the cosmetic container having the sealing structure between the inner container and the inner container cap according to one embodiment of the present invention.
Figure 5:
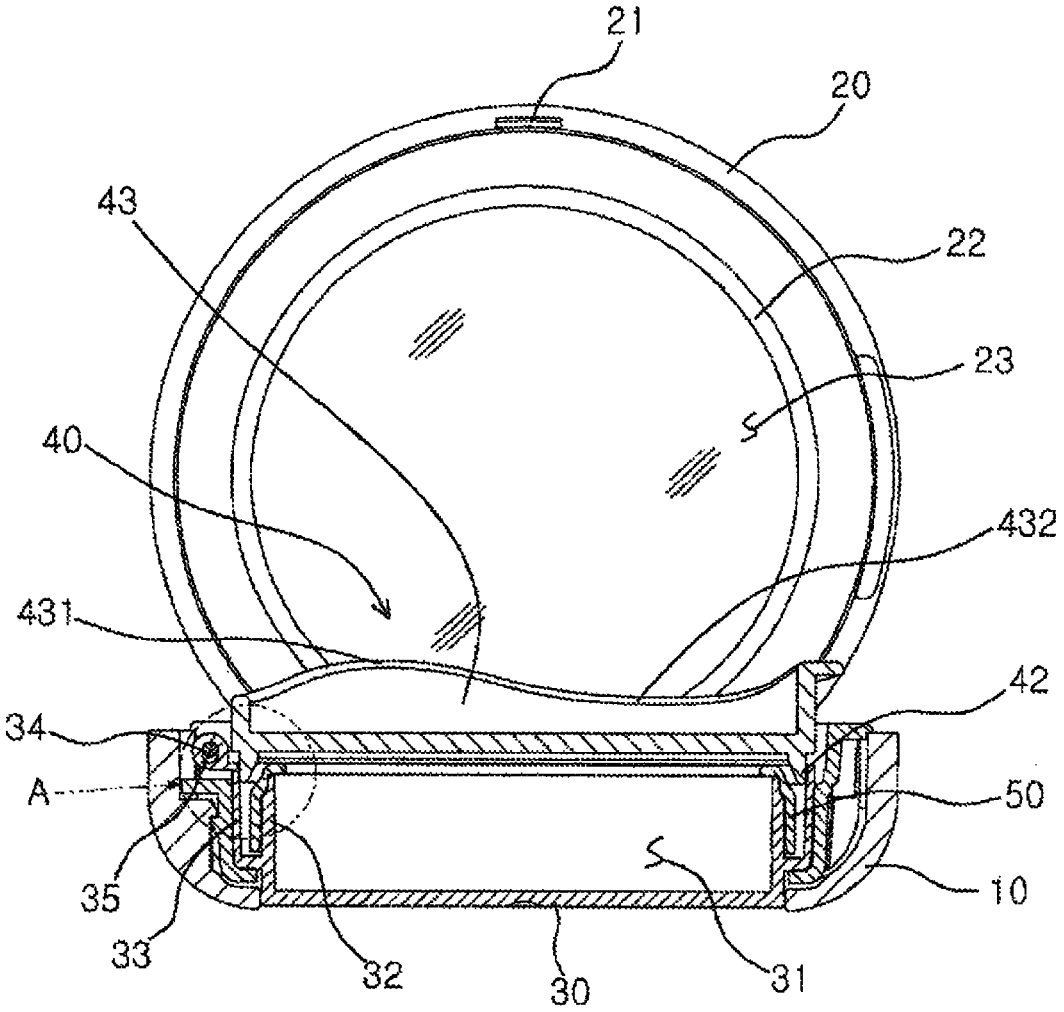
FIG. 5 is a sectional view showing the closing state of the inner container when the outer container is open in the cosmetic container having the sealing structure between the inner container and the inner container cap according to one embodiment of the present invention.
Figure 6:
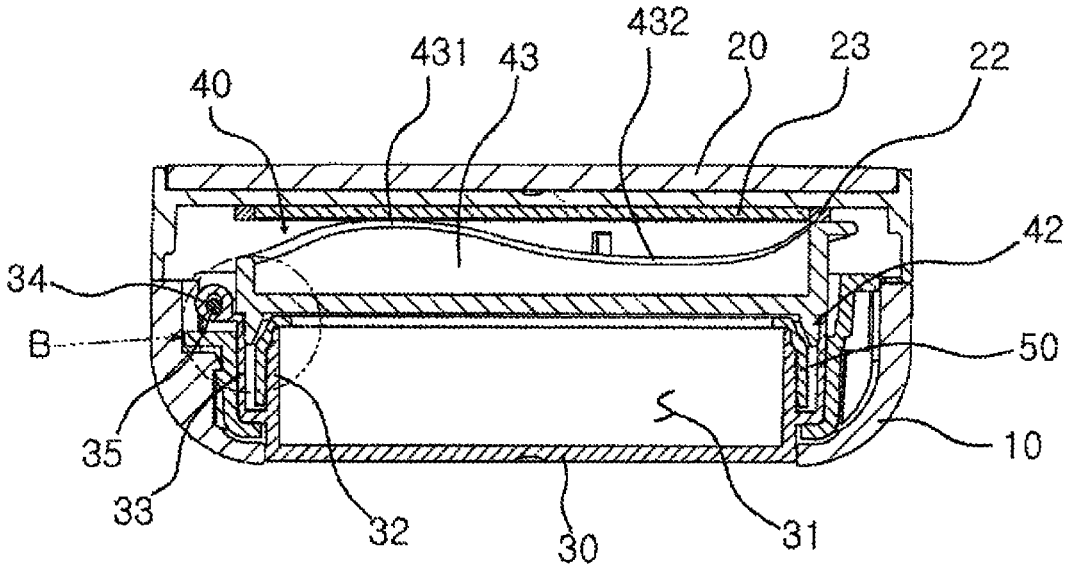
FIG. 6 is a sectional view showing the closing state of the outer container in the cosmetic container having the sealing structure between the inner container and the inner container cap according to one embodiment of the present invention.
Figure 7:
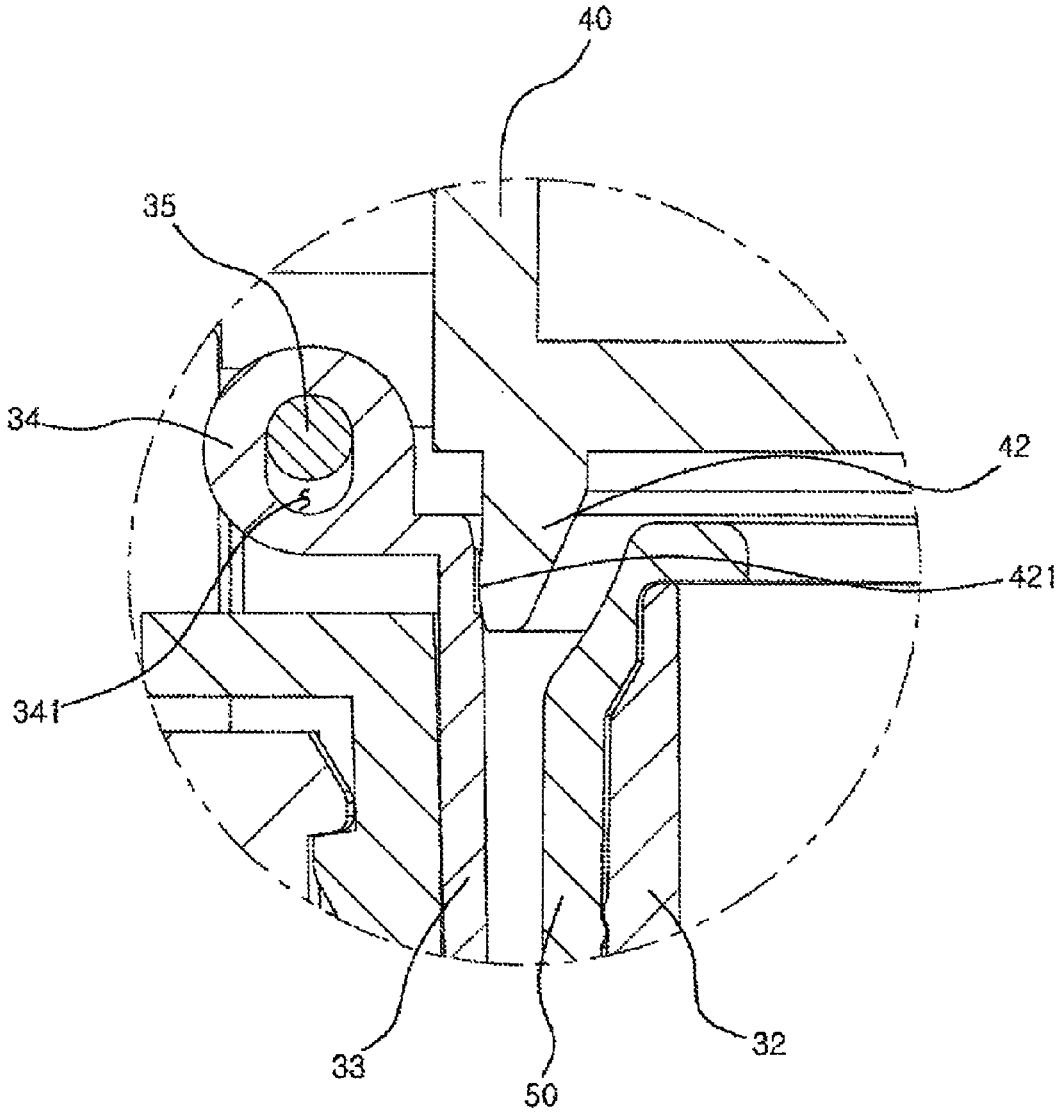
FIG. 7 is an enlarged sectional view showing part A of FIG. 5.
Figure 8:
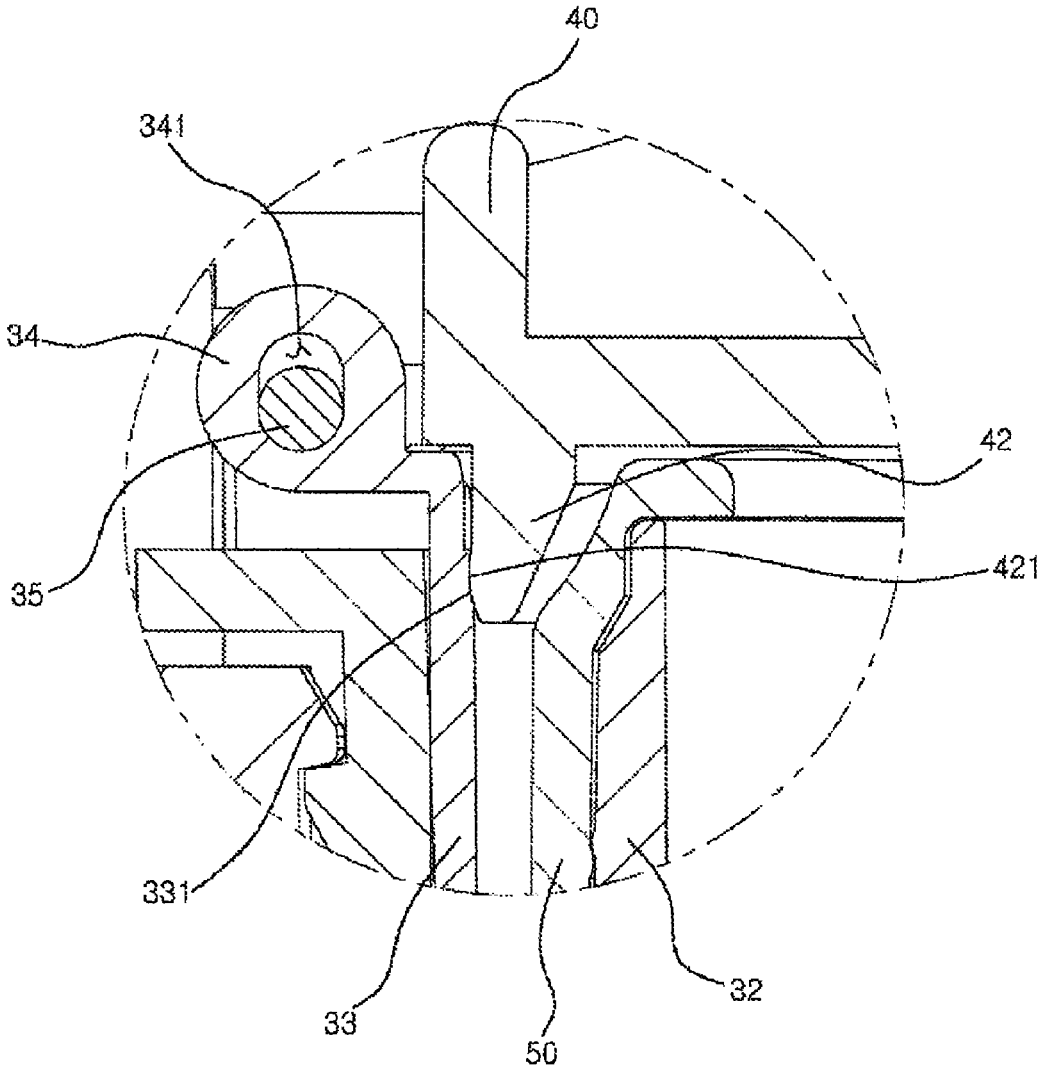
FIG. 8 is an enlarged sectional view showing part B of FIG. 6.
Figure 9:
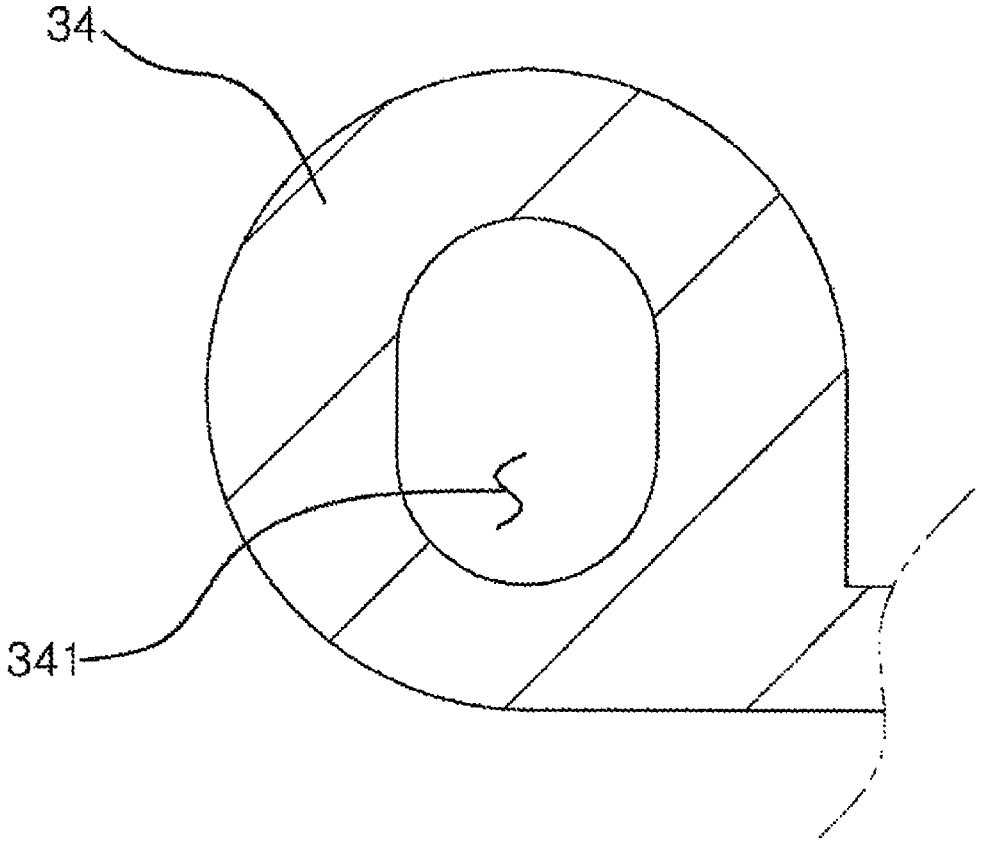
FIG. 9 is an enlarged sectional view showing a first hinge block formed in the inner container in the cosmetic container having the sealing structure between the inner container and the inner container cap according to one embodiment of the present invention.

FIG. 2 is a perspective view showing an open state of an outer container in a cosmetic container having a sealing structure between an inner container and an inner container cap according to one embodiment of the present invention. FIG. 3 is an exploded perspective view showing the cosmetic container having the sealing structure between the inner container and the inner container cap according to one embodiment of the present, invention. FIG. 4 is a sectional view showing the closing state of an inner container when the outer container is open in the cosmetic container having the sealing structure between the inner container and the inner container cap according to one embodiment of the present invention. FIG. 5 is a sectional view showing the closing state of the inner container when the outer container is open in the cosmetic container having the sealing structure between the inner container and the inner container cap according to one embodiment of the present invention. FIG. 6 is a sectional view showing the closing state of the outer container in the cosmetic container having the sealing structure between the inner container and the inner container cap according to one embodiment of the present invention. FIG. 7 is an enlarged sectional view showing part A of FIG. 5. FIG. 8 is an enlarged sectional view showing part B of FIG. 6. FIG. 9 is an enlarged sectional view showing a first hinge block formed in the inner container in the cosmetic container having the sealing structure between the inner container and the inner container cap according to one embodiment of the present invention.

The present invention is configured to include an outer container 10 formed therein with an inner container receiving groove 11, an outer container cap 20 hinged with the outer container 10 and formed therein with a press projecting ring 22, an inner container 30 received in the outer container 10 and having an outer wall 33 and a first hinge block 34, and an inner container cap 40 hinged with the first hinge block 34 of the inner container 30.

The inner container cap 40 is formed at a lower portion thereof with a sealing projecting ring 42 formed at a lower portion thereof, and an outer diameter of the sealing projecting ring 42 is larger than an inner diameter of the outer wall 33 of the inner container 30 so that the inner container cap 40 is forcibly fitted into an inside of the outer wall 33.

The inner container cap 40 is formed on an upper portion thereof with an extension projecting ring 43 to be pressed by the press projecting ring 22 of the outer container cap 20.

The outer container 10 includes a button 12 formed at one lateral side thereof with a locking protrusion 121, and a hinge formed at a side facing the button 12 so that the outer container 10 is hinged with the outer container cap 20. The outer container 10 is formed therein with the inner container receiving groove 11.

The inner container 30 is mounted in the inner container receiving groove 11.

Regarding the button 12, as the locking protrusion 121 extending from an upper portion of the button 12 is moved back by the pressing operation of a user, the locking protrusion 121 is unhooked from a hook 21 of the outer container cap 20, so that the outer container cap 20 is open.

The outer container cap 20, which covers an upper portion of the outer container 10, is hinged with the outer container 10 to open or close the outer container 10.

The hook 21 is formed at one side of the outer container cap 20 and formed in the shape of a protrusion corresponding to the locking protrusion 121 of the outer container 10.

A mirror 23 may be attached to an inner side of the outer container cap 20. The user may open the outer container cap 20 to make up while looking into the mirror 23.

A press projecting ring 22 is formed on the rim of the mirror 23 provided inside the outer container cap 20. Accordingly, when the outer container cap 20 is closed, the press projecting ring 22 presses the extension projecting ring 43 formed on the inner container cap 40.

The inner container 30 includes a content receiving space 31, and has an inner wall 32 and an outer wall 33 formed at a lateral side thereof. The first hinge block 34 is formed on an upper end of the outer wall 33.

The inner container 30 is mounted in an inner container receiving groove 11 of the outer container 10.

The content receiving space 31 receives contents, and the contents include foundation containing a large amount of volatile solvent, or contents which are able to be impregnated into an impregnation member such as sponge.

A fixing member 50 may be additionally coupled between the inner wall 32 and the outer wall 33.

As shown in FIGS. 4 to 6, the fixing member 50 is coupled to an outside of the inner wall 32 to prevent the contents received in the inner container 30 or the impregnation member from being separated from the inner container 30.

As shown in FIGS. 5 to 8, the outer wall 33 increases the airtightness of the inner container 30 as the sealing projecting ring 42 of the inner container cap 40 is fitted into the outer wall 33.

As shown in FIG. 9, the first hinge block 34 is formed therein with a hinge hole 341 having an oval shape.

The hinge hole 341 is hinged with the inner container cap 40 by a hinge pin 35, and the hinge pin 35 is located in an upper portion of the hinge hole 341 when the inner container cap 40 is covered on the inner container 30 as shown in FIGS. 4, 5, and 7.

In the state that the hinge pin 35 is located in the upper portion of the hinge hole 341 as described above, when the outer container cap 20 is covered, as the press projecting ring 22 formed inside the outer container cap 20 presses the extension projecting ring 43 formed on the inner container cap 40 to push down the inner container cap 40, the hinge pin 35 is moved to a lower portion of the hinge hole 341 as shown in FIGS. 6 and 8.

In other words, the state shown in FIG. 7 becomes changed to the state shown in FIG. 8, so that the inner container 30 is sealed.

The inner container cap 40 may be formed in a top surface thereof with a puff space 41 to store a puff (not shown), which is a makeup tool, formed at the lower portion thereof with the sealing projecting ring 42, and formed on the upper portion thereof with the extension projecting ring 43.

The inner container cap 40 is formed at one side thereof with a second hinge block 44 and hinged with the first hinge block 34 of the inner container 30 by the hinge pin 35.

As shown in FIGS. 5 to 8, the sealing projecting ring 42 is fitted to the inside of the outer wall 33 of the inner container 30. In this case, the outer diameter of the sealing projecting ring 42 is larger than the inner diameter of the outer wall 33, so that the sealing projecting ring 42 is forcibly fitted into the inside of the outer wall 33, thereby increasing the airtightness of the inner container 30.

It is preferred that, the outer diameter of the sealing projecting ring 42 is 0.01 mm to 1.0 mm larger than the inner diameter of the outer wall 33.

If the outer diameter of the sealing projecting ring 42 is larger than the inner diameter of the outer wall 33 of the inner container 30 by less than 0.01 mm, the volatile material of the contents received in the inner container 30 may be volatilized, so that pressure may be increased. In this case, the sealing projecting ring 42 does not overcome the discharge pressure of the volatile material, so that the volatile material of the contents may leak out.

Alternatively, if the outer diameter of the sealing projecting ring 42 is larger than the inner diameter of the outer wall 33 of the inner container 30 by 1.0 mm or more, the sealing projecting ring 42 of the inner container cap 40 may be forcibly fitted into the inside of the outer wall 33 of the inner container 30, so that the fatigue of the outer wall 33 of the inner container 30 may be accumulated. Accordingly, the outer wall 33 may be cracked, so that the volatile material of the contents may be leak out.

A sealing annular protrusion 421 is formed on an outer circumferential surface of the sealing projecting ring 42 so that the sealing projecting ring 42 is forcibly fitted into the inner side of the outer wall 33 to more increase the airtightness of the inner container 30.

The extension projecting ring 43 of the inner container cap 40 includes protrusion parts 431 and recess parts 432 which are repeatedly formed in a wave shape. In this case, three protrusion parts 431 and three recess parts 432 are formed at equal angles.

Regarding the extension projecting ring 43, when the sealing projecting ring 42 of the inner container cap 40 is fitted to the inside of the outer wall 33 of the inner container 30 as shown in FIG. 5, the press projecting ring 22 of the outer container cap 20 presses the extension projecting ring 43 as shown in FIG. 6.

In this case, the press projecting ring 22 uniformly presses the three protrusion parts 431 formed in the extension projecting ring 43.

Hereinafter, the assembling manner and the use state of the cosmetic container having the sealing structure between the inner container and the inner container cap according to one embodiment of the present invention will be described in detail.

According to the present invention, the outer container 10 formed therein with the inner container receiving groove 11 is hinged with the outer container cap 20 formed therein with the press projecting ring 22, and the inner container 30 is mounted in the inner container receiving groove 11 of the outer container 10.

The inner container 30 includes the inner wall 32 and the outer wall 33, and is hinged with the inner container cap 40. The inner container cap 40 is formed at the lower portion thereof with the sealing projecting ring 42 and formed at the upper portion thereof with the extension projecting ring 43.

The fixing member 50 may be additionally coupled between the inner wall 32 and the outer wall 33 of the inner container 30.

In order to use contents in the cosmetic container having the sealing structure between the inner container and the inner container cap according to the present invention, which has been assembled as described above, the outer container cap 20 is open and then the inner container cap 40 is open.

Thereafter, a user may make up with contents received in the inner container 30 using the puff.

In order for the user to seal the cosmetic container having the sealing structure between the inner container and the inner container cap according to the present Invention after finishing the makeup, the user may pivot the inner container cap 40 downward as shown in FIG. 4 to couple the inner container cap 40 to the inner container 30 as shown in FIG. 5.

In this case, the sealing projecting ring 42 formed at the lower portion of the inner container cap 40 has the outer diameter larger than the inner diameter of the outer wall 33 of the inner container 30, so that the sealing projecting ring 42 of the inner container cap 40 is seated on the inside of the outer wall 33 of the inner container 30 as shown in FIG. 7.

Thereafter, as shown in FIG. 6, when the outer container cap 20 is coupled to the outer container 10 while closing the outer container 10, the press projecting ring 22 formed inside the outer container cap 20 presses the extension projecting ring 43 formed on the upper portion of the inner container cap 40.

The extension projecting ring 43 of the inner container cap 40 includes the protrusion part 431 and the recess part 432 which are alternately provided while forming the wave shape. In this case, three protrusion parts 431 and three recess parts 432 are formed at equal angles. In this case, the press projecting ring 22 uniformly presses the three protrusion parts 431 to push the sealing projecting ring 42 of the inner container cap 40 to the lower portion of the outer wall 33 of the inner container 30.

The press projecting ring 22 of the outer container cap 20 forcibly presses the protrusion part 431 of the extension projecting ring 43 of the inner container cap 40 so that the inner container cap 40 seals the inner container 30. Accordingly, pressure occurs in the inner container 30. In this case, the outer container cap 20 is coupled to the outer container 10 to prevent the inner container cap 40 from being lifted up.

The hinge pin 35 which couples the inner container 30 to the inner container cap 40 and is located in the upper portion of the first hinge hole 341 of the first hinge block 34 as shown in FIG. 7, is moved to the lower portion of the hinge hole 341 of the first hinge block 34 as shown in FIG. 8 due to pressing by the press projecting ring 22.

In this case, a hinge pin 235 is placed in a second hinge hole 342 by a locking step 343 interposed between the first hinge hole 341 and the second hinge hole 342 to increase the sealing of the inner container 30.

In addition, as shown in FIG. 8, the sealing annular protrusion 421 formed on the outer circumferential surface of the sealing projecting ring 42 is securely fitted to an inner circumferential surface of the upper end of the outer wall 33, so that the sealing of the inner container 30 may be increased.

Although the cosmetic container having the sealing structure between the inner container and the inner container cap according to one embodiment of the present invention has been described for the illustrative purpose, the present invention is not limited thereto. It is understood that various changes and modifications can be made by a person skilled in the art within the spirit and scope of the present invention without departing from the subject matter of the present invention as hereinafter claimed.

BRIEF DESCRIPTION OF REFERENCE NUMERALS

10: Outer container
11: Inner container receiving groove
12: Button
121: Locking protrusion
20: Outer container cap
21: Hook
22: Press projecting ring
23: Mirror
30: Inner container
31: Content receiving space
32: Inner wall
33: Outer wall
34: First hinge block

341: Hinge hole
35: Hinge pin
40: Inner container cap
41: Puff space
42: Sealing projecting ring
421: Sealing annular protrusion
43: Extension projecting ring
431: Protrusion part
432: Recess part
44: Second hinge block
50: Fixing member

The invention claimed is:

1. A cosmetic container having a sealing structure between an inner container and an inner container cap, the cosmetic container comprising:

an outer container (10) formed therein with an inner container receiving groove (11);

an outer container cap (20) hinged with the outer container (10) and formed therein with a press projecting ring (22);

an inner container (30) received in the outer container (10) and having an outer wall (33) and a first hinge block (34); and an inner container cap (40) hinged with the first hinge block (34) of the inner container (30), wherein the inner container cap (40) is formed at a lower portion thereof with a sealing projecting ring (42), and an outer diameter of the sealing projecting ring (42) is larger than an inner diameter of the outer wall (33) of the inner container (30) such that the inner container cap (40) is forcibly fitted to an inside of the outer wall (33), and wherein the inner container cap (40) is formed at an upper portion thereof with an extension projecting ring (43) to be pressed by the press projecting ring (22) of the outer container cap (20).

2. A cosmetic container having a sealing structure between an inner container and an inner container cap, wherein an outer container (10) formed therein with an inner container receiving groove (11) is hinged with an outer container cap (20) formed therein with a press projecting ring (22), an inner container (30) having an outer wall (33) and a first hinge block (34) are mounted inside the outer container (10), the inner container (30) is hinged with an inner container cap (40), and the inner container cap (40) is formed at a lower portion thereof with a sealing projecting ring (42), and formed at an upper portion thereof with an extension projecting ring (43).

3. The cosmetic container of claim 2, wherein an inner wall (32) is additionally formed inside the outer wall (33) of the inner container (30).

4. The cosmetic container of claim 2, wherein the outer diameter of the sealing projecting ring (42) is 0.1 mm to 1.0 mm larger than the inner diameter of the outer wall (33) of the inner container (30).

5. The cosmetic container of claim 2, wherein the first hinge block (34) is formed therein with a hinge hole (341) having an oval shape.

6. The cosmetic container of claim 2, wherein the sealing projecting ring (42) is formed on an outer circumferential surface thereof with a sealing annular protrusion (421).

7. The cosmetic container of claim 2, wherein the extension projecting ring (43) includes three protrusion parts (431) and three recess parts (432) which are repeatedly formed and formed at equal angles.

8. The cosmetic container of claim 2, wherein a fixing member (50) is additionally coupled between an inner wall (32) and the outer wall (33) of the inner container (30).

9. The cosmetic container of claim 1, wherein an inner wall (32) is additionally formed inside the outer wall (33) of the inner container (30).

10. The cosmetic container of claim 1, wherein the outer diameter of the sealing projecting ring (42) is 0.1 mm to 1.0 mm larger than the inner diameter of the outer wall (33) of the inner container (30).

11. The cosmetic container of claim 1, wherein the first hinge block (34) is formed therein with a hinge hole (341) having an oval shape.

12. The cosmetic container of claim 1, wherein the sealing projecting ring (42) is formed on an outer circumferential surface thereof with a sealing annular protrusion (421).

13. The cosmetic container of claim 1, wherein the extension projecting ring (43) includes three protrusion parts (431) and three recess parts (432) which are repeatedly formed and formed at equal angles.

14. The cosmetic container of claim 1, wherein a fixing member (50) is additionally coupled between an inner wall (32) and the outer wall (33) of the inner container (30).

* * * * *